US010103464B2

(12) United States Patent
Xu et al.

(10) Patent No.: US 10,103,464 B2
(45) Date of Patent: Oct. 16, 2018

(54) CONNECTION STRUCTURE OF PLUG-IN POWER SUPPLY AND LIGHT SOURCE PLATE

(71) Applicant: Ningbo Yamao Optoelectronics Co., ltd., Zhejiang (CN)

(72) Inventors: Qili Xu, Zhejiang (CN); Hu Fang, Zhejiang (CN); Yinyong Zhou, Zhejiang (CN)

(73) Assignee: NINGBO YAMAO OPTOELECTRONICS CO., LTD., Zhenjiang (CN)

( * ) Notice: Subject to any disclaimer, the term of this patent is extended or adjusted under 35 U.S.C. 154(b) by 0 days.

(21) Appl. No.: 15/710,156

(22) Filed: Sep. 20, 2017

(65) Prior Publication Data

US 2018/0198224 A1 Jul. 12, 2018

(30) Foreign Application Priority Data

Jan. 9, 2017 (CN) ..... 2017 1 0014908

(51) Int. Cl.

*H01R 12/72* (2011.01)
*H01R 13/02* (2006.01)
*H01R 12/70* (2011.01)
*H01R 13/68* (2011.01)

(52) U.S. Cl.

CPC ..... *H01R 12/72* (2013.01); *H01R 12/7088* (2013.01); *H01R 13/02* (2013.01); *H01R 13/68* (2013.01)

(58) Field of Classification Search

CPC ..... H01R 13/717; H01R 23/6813
USPC ..... 439/490, 607.22, 31, 33, 76.1; 362/95
See application file for complete search history.

(56) References Cited

U.S. PATENT DOCUMENTS 5,122,064 A * 6/1992 Zarreii ..... H01R 12/58 439/65
5,455,742 A * 10/1995 Phoy ..... H05K 3/366 174/250
5,484,965 A * 1/1996 Woychik ..... H05K 3/3452 174/260
5,629,839 A * 5/1997 Woychik ..... H05K 3/366 361/784
6,176,743 B1 * 1/2001 Kuo ..... H01R 31/06 439/638

(Continued)

FOREIGN PATENT DOCUMENTS

CN 205592804 U * 9/2016 ..... F21S 8/04

*Primary Examiner* — Tulsidas C Patel
*Assistant Examiner* — Peter G Leigh
(74) *Attorney, Agent, or Firm* — Andrew F. Young, Esq.; Lackenbach Siegel, LLP

(57) ABSTRACT

The present invention provides a connection structure of a plug-in power supply and a light source plate, and it relates to the field of electronic circuit connection. The connection structure of the plug-in power supply and the light source plate comprises: a card slot, which is soldered on the light source plate; a card, which is matched with the card slot and soldered on the power supply; metal contacts, which is arranged in the card slot; pre-printed circuits connected to the metal contacts and arranged on the card; the power supply is connected to the light source plate through the matching of the card slot and the card, which facilitates the disassembly and assembly and improves the production efficiency.

7 Claims, 4 Drawing Sheets

(56) References Cited

U.S. PATENT DOCUMENTS

| | | | | |
|---|---|---|---|---|
| 6,496,384 | B1 * | 12/2002 | Morales | H05K 3/366 29/830 |
| 6,568,944 | B1 * | 5/2003 | Meyer | H05K 1/141 439/79 |
| 6,661,674 | B2 * | 12/2003 | Reniers | H01R 9/096 361/743 |
| 6,873,800 | B1 * | 3/2005 | Wei | G02B 6/4204 385/14 |
| 7,155,815 | B2 * | 1/2007 | Gernhardt | H05K 3/3442 29/412 |
| 7,273,379 | B2 * | 9/2007 | Jang | H05K 3/366 361/803 |
| 7,410,362 | B2 * | 8/2008 | Chou | H01R 4/027 439/65 |
| 7,482,800 | B2 * | 1/2009 | Ooyabu | H05K 3/363 174/255 |
| 7,637,784 | B2 * | 12/2009 | Evans | H01R 31/065 439/638 |
| 7,716,821 | B2 * | 5/2010 | Yan | H05K 3/366 228/180.22 |
| 7,864,544 | B2 * | 1/2011 | Smith | H05K 3/366 361/770 |
| 9,380,704 | B2 * | 6/2016 | Kashiwakura | H05K 1/0246 |
| 9,780,471 | B2 * | 10/2017 | Van Rijswijk | H01R 12/737 |
| 2013/0335931 | A1 * | 12/2013 | Snider | H05K 3/3436 361/751 |
| 2016/0192515 | A1 * | 6/2016 | Chen | H01R 12/73 361/740 |
| 2016/0380372 | A1 * | 12/2016 | Hsieh | H01R 24/60 439/676 |

* cited by examiner

CONNECTION STRUCTURE OF PLUG-IN POWER SUPPLY AND LIGHT SOURCE PLATE

CROSS-REFERENCE TO RELATED APPLICATIONS

The present application claims priority to and the benefit of Chinese Patent Application No. CN 201710014908.1, filed on Jan. 9, 2017, the entire content of which is incorporated herein by reference.

BACKGROUND OF THE INVENTION

1. Field of the Invention

The invention relates to the field of electronic circuit connection, more specifically, to a connection structure of a plug-in power supply and a light source plate.

2. Description of the Related Art

With the development of science and technology and the popularity of electricity, electronic products play an increasingly important role in people's lives, and facilitate people's lives. Therefore, the studies of electronic products have become the focus.

LED (Light Emitting Diode) light, as one kind of light in the electronic products, has the advantages of long life, high brightness, short response time and high security, which lead to the rapid popularization of LED lights. However, in the prior art, when LED lights are assembled, the connection between the power supply and the light source is directly soldered to the light source plate through a wire, and two or four soldering joints for the power access are preset on the light source plate, and the soldering process is used to solder the power access lines to the light source plate so as to complete the assembly of the products. The soldering process is manual soldering, and the manual soldering is difficult to control the amount of solder. If the soldering is too much, it may cause short-circuit between electronic devices; if the soldering is too little, it may cause the problems such as desoldering, bubbles and pinholes etc. The manual soldering is also likely to cause false soldering, pseudo soldering and so on, which may cause the circuit barrier, and affect the quality and safety of products. Furthermore, manual soldering process is difficult to adapt to the demands of automation and semi-automation production, it limits the automation and semi-automation production, and results in low production efficiency.

In summary, the present method of connection of LED lights has the problems of the poor soldering quality of product, low production efficiency and low safety.

SUMMARY OF THE INVENTION

For the deficiencies of the prior art, the present invention provides a connection structure of a plug-in power supply and a light source plate for arranging a card slot on the light source plate, a card on the power supply, and fixedly matching the card slot with the card. The connection between the power supply and the light source plate through plug-in connection method makes the connection process simple, the connection reliable, and it improves production efficiency, product quality and product safety.

The specific technical scheme is as follows:

A connection structure of a plug-in power supply and a light source plate, comprising: a light source plate, a power supply and a connection structure, the connection structure connects the power supply and the light source plate, and the connection structure comprising a card slot and a card, and the card slot is fixedly soldered on the light source plate, and metal contacts are arranged in the card slot, the card is soldered on a power supply board of the power supply, circuits are arranged on the card, the circuits are provided with convex soldering tins, the card is matched with the card slot, the metal contacts are fixedly matched with the convex soldering tins.

In the above-mentioned connection structure of the plug-in power supply and the light source plate the connection structure comprises a single card slot or a plurality of card slots, and if the connection structure comprises a plurality of card slots, the card slots are arranged in the same direction.

In the above-mentioned connection structure of the plug-in power supply and the light source plate, each card slot is symmetrically arranged with two sets of metal contact, and each set of metal contacts comprises two parallel metal contact strips.

In the above-mentioned connection structure of the plug-in power supply and the light source plate, an exterior of each card slot provides with a plurality of metal brackets, and each metal bracket is soldered on the light source plate.

In the above-mentioned connection structure of the plug-in power supply and the light source plate, the metal contact strips in each card slot are connected with one of the metal brackets, and the metal contacts and the metal brackets are arranged integrally.

In the above-mentioned connection structure of the plug-in power supply and the light source plate, the metal contact and the card slot are an integral injection molding piece.

In the above-mentioned connection structure of the plug-in power supply and the light source plate, the circuits on the card are two pre-printed circuits, and two sets of pre-printed circuits are symmetrically arranged on the card, and each set of pre-printed circuits comprises two output points arranged parallel, and a location arrangement of the two output points of each set is identical to a location arrangement of the two metal contact strips of each set.

In the above-mentioned connection structure of the plug-in power supply and the light source plate, the convex soldering tins are set at each output point, and protrusion heights of the convex soldering tins of the same set are identical.

In the above-mentioned connection structure of the plug-in power supply and the light source plate, an elastic piece is arranged between each of the convex soldering tins and one of the output points.

In the above-mentioned connection structure of the plug-in power supply and the light source plate, one end of the elastic piece adjacent to the output point is connected with a length of fuse.

The positive effect of the above technical scheme is that: 1. replacing the traditional wire soldering with the matching connection between the card slot and the card, which improves the reliability and security of the connection, and facilitates the connection process and improves the production efficiency; 2. The matching connection between the card slot and the card is more suitable for automatic and semi-automatic production, and large-scale production; 3. the elastic piece arranged between the output point on the card and the soldering tin facilitates disassembly and assembly, the later replacement and maintenance, and reduces the costs; 4. The metal contacts in the card slot and the metal brackets outside the card slot are arranged integrally to ensure the stability of the connection, and the metal contacts and the card slot are an integral injection molding piece, which is more secure; 5. a length of fuse is arranged on the elastic piece so that the circuit can be cut off automatically when the fault occurs, and the safety accident is avoided, and it is more secure.

BRIEF DESCRIPTIONS OF THE DRAWINGS

The accompanying drawings, together with the specification, illustrate exemplary embodiments of the present disclosure, and, together with the description, serve to explain the principles of the present invention.

Figure 1:
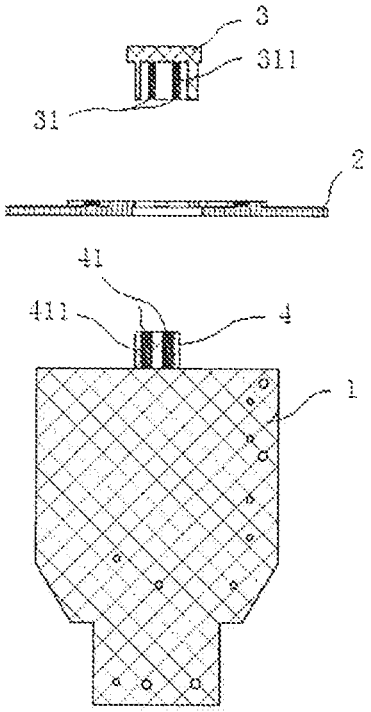
FIG. 1 is a frame structure of a connection structure of a plug-in power supply and a light source plate of the present invention.

In drawings: 1. power supply; 2. light source plate; 3. card slot; 31. metal contact; 311. metal contact strip; 4. card; 41. pre-printed circuit; 411. output point; 32. Metal bracket; 411*a*. soldering tins.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or sets thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

FIG. 1 is a frame structure of a connection structure of a plug-in power supply and a light source plate of the present invention.

Figure 2:
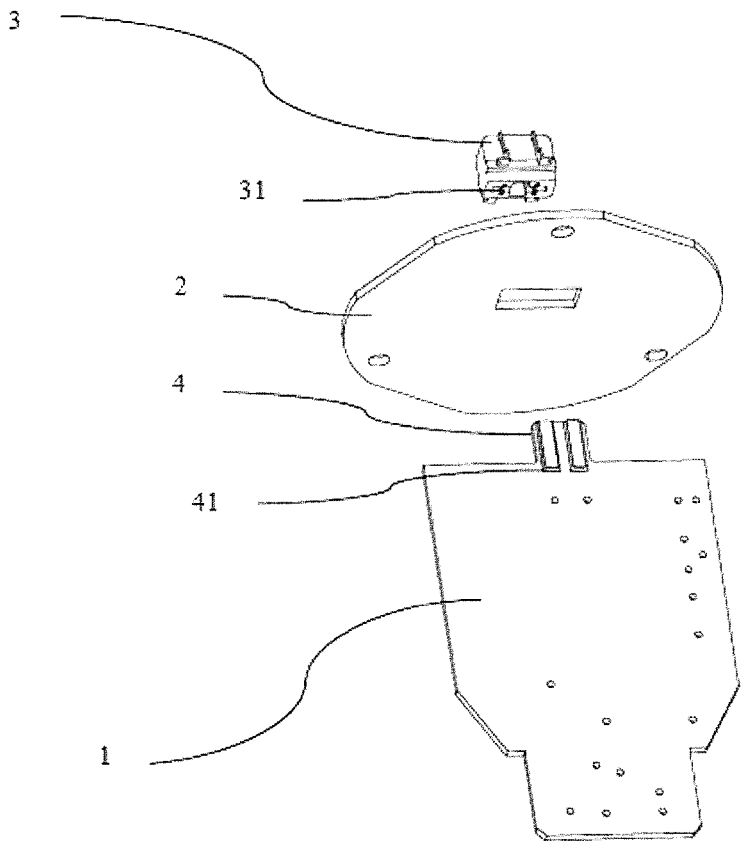
FIG. 2 is an exploded view of a connection structure of a plug-in power supply and a light source plate of the present invention.

FIG. 2 is an exploded view of a connection structure of a plug-in power supply and a light source plate of the present invention.

Figure 3:
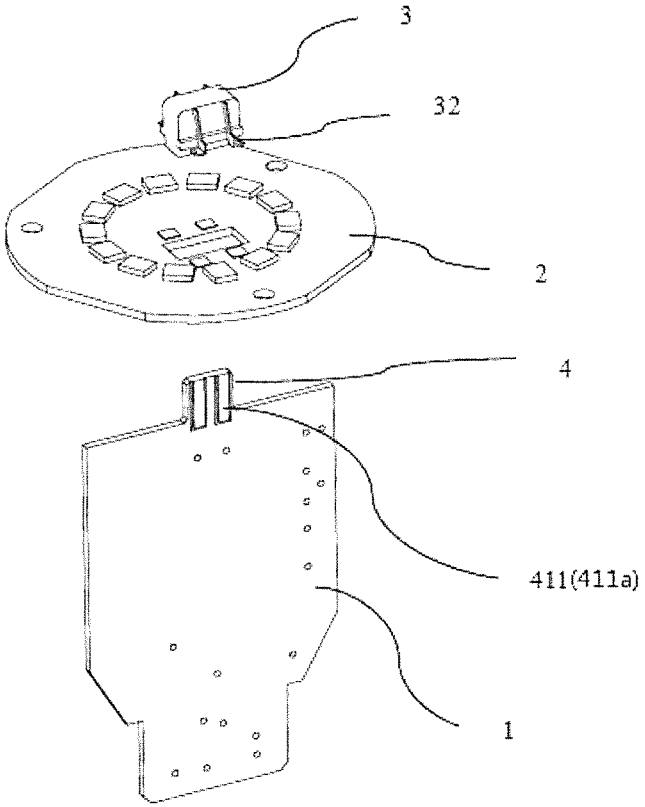
FIG. 3 is an exploded view of a connection structure of a plug-in power supply and a light source plate of the present invention.

FIG. 3 is an exploded view of a connection structure of a plug-in power supply and a light source plate of the present invention.

Figure 4:
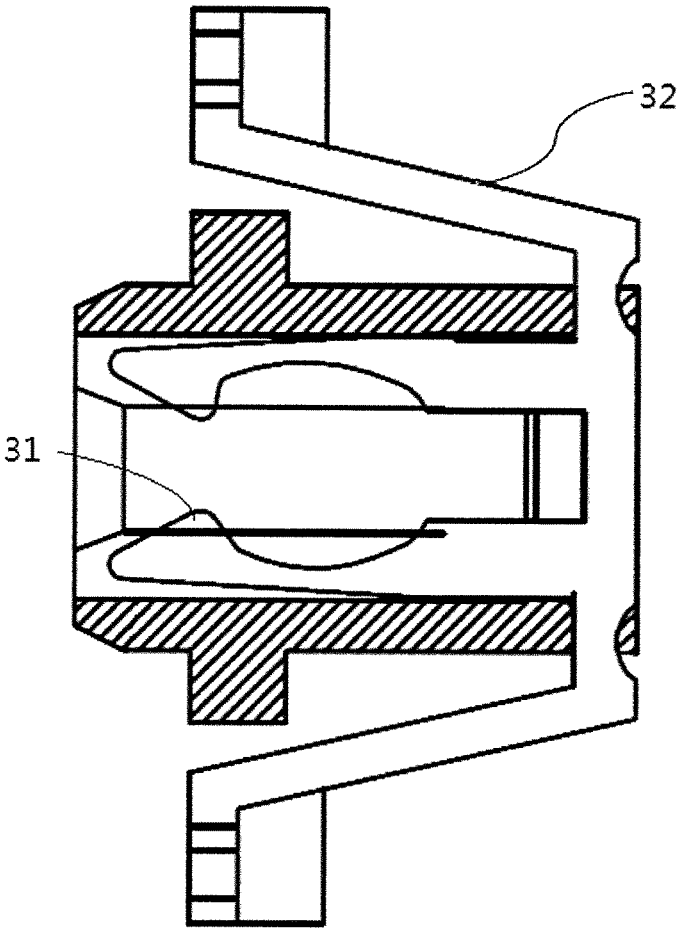
FIG. 4 is a partial section view of the card slot of the present invention.

FIG. 4 is a partial section view of the card slot of the present invention.

As shown in FIG. 1, FIG. 2, FIG. 3 and FIG. 4, the connection structure of a plug-in power supply and a light source plate provided by the embodiment comprises: a power supply 1, a light source plate 2, a card slot 3, metal contacts 31, metal contact strips 311, a card 4, pre-printed circuits 41, an output point 411.

Specifically, the power supply 1 is arranged oppositely to the light source plate 2, and the card slot 3 is soldered to the light source plate 2, the card 4 is soldered to the power supply 1, and the card slot 3 is matched with the card 4 to realize the connection between the light source plate 2 and the power supply 1.

Specifically, the light source plate 2 is provided with a plurality of contacts (not shown), and the number of the contacts on the light source plate 2 is arranged according to the demands, it ensures that the light source plate 2 can be soldered with enough card slot 3 for the power supply, and the adaptability thereof is higher.

Specifically, the card slot 3 is symmetrically provided with two sets of metal contacts 31, and each set of metal contacts 31 comprises two metal contact strips 311 which are arranged parallel, and the arrangement direction of the metal contact strips 311 is identical to the arrangement direction of the card slot 3.

Specifically, a plurality of metal brackets 32 are arranged outside the slot 3, the metal brackets are soldered to the contacts of the light source plate 2, and one metal bracket is soldered to one contact.

Each of the metal brackets outside the card slot 3 connects one metal contact strip 311 in the card slot 3, and the metal bracket is arranged integrally with the metal contact strip 311, so that the connection is better and the power supply stability is higher.

More specifically, the corresponding card 4 is arranged on the power supply 1, and the number of the cards 4 is the same as the number of the card slots 3, and one card 4 corresponds to one card slot 3.

The card 4 is symmetrically arranged with two sets of circuits, the two sets of circuits are pre-printed circuit 41, which effectively improves the security thereof and facilitates the connection of the circuit; each set pre-printed circuit 41 comprises two parallel arranged output point 411, and the arrangement direction of the output point 411 is identical to the arrangement direction of the contact strips 311, the location arrangement of the two sets of output points 411 of the same set are identical to the location arrangement of two metal contact bars 311 of the same set, it ensures that when the card 4 inserts into the card slot 3, one output point 411 can accurately communicate with one metal contact strip 311 to ensure the stability of the electrifying.

More specifically, the convex soldering tins 411*a* are arranged on each output point 411, and the protrusion heights of the convex soldering tins of the same set are identical. It ensures that the card 4 can be more conveniently matched with the card slot 3 to avoid the problem of poor contact.

An elastic piece (not shown) is arranged between each convex soldering tin and the corresponding output point 411 to facilitate the disassembly and assembly of the card slot 3 on the card 4, and the later replacement and maintenance, and to avoid the high cost brought by replacing the entire components.

More specifically, a length of fuse (not shown) is arranged on an end of the elastic piece adjacent to the output point 411, so that the circuit can be cut off automatically when the light fault occurs, and it ensures the integrity of other circuits so as to avoid damaging other operating components, and the security is improved.

As a preferred embodiment, the metal contacts 31 and card slot 3 are an integral injection molding piece, which makes the installation more secure, more easy to make, and more suitable for automatic and semi-automatic production, and improves the production efficiency.

As a preferred embodiment, the light source plate 2, which is soldered with the card slot 3, is mounted on the heat conducting board (not shown) to effectively dissipate the heat generated by the operation of the light source plate 2, so as to avoid the burnout of the components and to provide better protection.

The connection structure of the plug-in power supply and the light source plate provided by the present embodiment comprises: a card slot 3, which is soldered on the light source plate 2; a card 4, which is matched with the card slot 3 and soldered on the power supply 1; metal contacts 31, which is arranged in the card slot 3; pre-printed circuits 41 connected to the metal contacts 31 and arranged on the card 4; the power supply 1 is connected to the light source plate 2 through the matching of the card slot 3 and the card 4, which facilitates the disassembly and assembly and improves the production efficiency; and the metal contacts 31 in the card slot 3 is matched with the output point 411 of the pre-print circuit 41 on the card 4 to ensure the stability of the connection, it makes the connection effect better and the more secure; convex soldering tins, the elastic piece, and the fuses are arranged on the output point 411, which make the electrifying of the light more stable, so as to avoid the problem of poor contact, and make the security higher and the maintenance cost lower.

The foregoing is only the preferred embodiments of the invention, not thus limiting embodiments and scope of the invention, those skilled in the art should be able to realize that the schemes obtained from the content of specification and figures of the invention are within the scope of the invention.

What is claimed is:

1. A connection structure of a plug-in power supply and a light source plate, comprising: a light source plate, a power supply and a connection structure, the connection structure connecting the power supply and the light source plate; the connection structure comprising a card slot and a card, and the card slot being fixedly soldered on the light source plate, and metal contacts being arranged in the card slot, the card being soldered on a power supply board of the power supply, circuits being arranged on the card, the circuits being provided with convex soldering tins, the card being matched with the card slot, the metal contacts being fixedly matched with the convex soldering tins;

the connection structure comprises a single card slot or a plurality of card slots, and if the connection structure comprises a plurality of card slots, the card slots are arranged in the same direction;

each card slot is symmetrically arranged with two sets of metal contacts, and each set of metal contacts comprises two parallel metal contact strips; and an exterior of each card slot is provided with a plurality of metal brackets, and each metal bracket is soldered on the light source plate.

2. The connection structure of the plug-in power supply and the light source plate according to claim 1, wherein the metal contact strips in each card slot are connected with one of the metal brackets, and the metal contacts and the metal brackets are arranged integrally.

3. The connection structure of the plug-in power supply and the light source plate according to claim 2, wherein the metal contact and the card slot are an integral injection molding piece.

4. The connection structure of the plug-in power supply and the light source plate according to claim 1, wherein the circuits on the card are two pre-printed circuits, and two sets of pre-printed circuits are symmetrically arranged on the card, and each set of pre-printed circuits comprises two output points arranged parallel, and a location arrangement of the two output points of each set is identical to a location arrangement of the two metal contact strips of each set.

5. The connection structure of the plug-in power supply and the light source plate according to claim 4, wherein the convex soldering tins are arranged at each output point, and protrusion heights of the convex soldering tins of the same set are identical.

6. The connection structure of the plug-in power supply and the light source plate according to claim 5, wherein an elastic piece is arranged between each convex soldering tin and one of the output points.

7. The connection structure of the plug-in power supply and the light source plate according to claim 6, wherein one end of the elastic piece adjacent to the output point is connected with a length of fuse.

* * * * *